US007059487B2

(12) United States Patent
Ohlsson

(10) Patent No.: US 7,059,487 B2
(45) Date of Patent: Jun. 13, 2006

(54) COLLAPSIBLE SEMI-RIGID CONTAINER

(75) Inventor: Per Ohlsson, Libertyville, IL (US)

(73) Assignee: Tetra Laval Holdings & Finance, SA, Pully (CH)

( * ) Notice: Subject to any disclaimer, the term of this patent is extended or adjusted under 35 U.S.C. 154(b) by 63 days.

(21) Appl. No.: 10/425,496

(22) Filed: Apr. 29, 2003

(65) Prior Publication Data

US 2004/0217084 A1 Nov. 4, 2004

(51) Int. Cl.
*B65D 1/02* (2006.01)
*B65D 23/10* (2006.01)
*B65D 8/14* (2006.01)

(52) U.S. Cl. ..... 215/381; 215/398; 215/900; 220/666; 222/107

(58) Field of Classification Search ..... 215/381, 215/900, 11.3, 398; 220/666, 8, 907; 222/107, 222/215
See application file for complete search history.

(56) References Cited

U.S. PATENT DOCUMENTS

| | | | | | |
|---|---|---|---|---|---|
| 2,876,113 | A | * | 3/1959 | Barton | 426/117 |
| 2,950,029 | A | * | 8/1960 | Winstead | 222/143 |
| 3,295,725 | A | * | 1/1967 | Brandt | 222/107 |
| 3,599,837 | A | * | 8/1971 | Anderson | 222/107 |
| 3,603,366 | A | * | 9/1971 | Albizati et al. | 604/317 |
| 4,072,249 | A | | 2/1978 | Ekenstam et al. | 222/95 |
| 4,282,986 | A | | 8/1981 | af Ekenstam et al. | 222/1 |
| 4,816,093 | A | * | 3/1989 | Robbins, III | 156/69 |
| 4,836,409 | A | | 6/1989 | Lane. | 220/495.01 |
| 4,836,970 | A | * | 6/1989 | Robbins, III | 264/515 |
| 4,890,757 | A | * | 1/1990 | Robbins, III | 220/675 |
| 4,925,055 | A | * | 5/1990 | Robbins et al. | 220/495.06 |
| 4,930,644 | A | | 6/1990 | Robbins, III | 215/382 |
| 4,979,628 | A | | 12/1990 | Robbins, III | 215/395 |
| 5,027,963 | A | | 7/1991 | Robbins, III | 215/900 |
| 5,048,977 | A | * | 9/1991 | Robbins, III | 383/104 |
| 5,206,037 | A | | 4/1993 | Robbins, III | 425/597 |
| 5,224,613 | A | | 7/1993 | Robbins, III | 215/10 |
| 5,226,551 | A | | 7/1993 | Robbins, III | 220/666 |
| 5,244,125 | A | | 9/1993 | Robbins, III | 222/382 |
| 5,292,242 | A | | 3/1994 | Robbins, III | 425/342.1 |
| 5,333,761 | A | * | 8/1994 | Davis et al. | 222/212 |
| 5,638,995 | A | | 6/1997 | Mazda | 222/215 |
| 5,642,826 | A | | 7/1997 | Melrose | 215/382 |
| 5,711,445 | A | | 1/1998 | Robbins, III | 220/666 |
| 5,860,556 | A | | 1/1999 | Robbins, III | 220/666 |
| 5,900,293 | A | | 5/1999 | Zettle | 220/666 X |

FOREIGN PATENT DOCUMENTS

| | | | |
|---|---|---|---|
| DE | 3530014 A1 | * | 2/1987 |
| EP | 0278764 A2 | * | 8/1988 |
| JP | 03289447 A | | 12/1991 |
| WO | WO 93/09031 | | 5/1993 |
| WO | WO 94/15846 | * | 7/1994 |

* cited by examiner

*Primary Examiner*—Sue A. Weaver
(74) *Attorney, Agent, or Firm*—Levenfeld Pearlstein, LLC

(57) ABSTRACT

A collapsible, semi-rigid container includes neck and bottom wall portions and a peripheral side wall extending between the neck and bottom wall. The side wall includes a rigid upper portion and a flexible lower portion. The lower portion of the side wall collapses into the upper portion reducing the internal volume of the container.

11 Claims, 2 Drawing Sheets

COLLAPSIBLE SEMI-RIGID CONTAINER

BACKGROUND OF THE INVENTION

The present invention is directed to a collapsible, semi-rigid container. More particularly, the present invention pertains to a collapsible, semi-rigid container having neck and bottom wall portions, and a peripheral side wall composed of an upper rigid portion, and a lower soft portion.

Food service operators often purchase products in large containers, as opposed to the much smaller containers commonly available in supermarkets. Frequently, operators choose to dispense products from the same containers in which they originally are packaged. When such containers are formed entirely of rigid materials, the package cannot collapse during dispensing. As a consequence, the dispensed product must be replaced using air that often has a deleterious effect on product shelf life.

The only way to ensure that products packaged within completely rigid containers are dispensed hygienically and aseptically (if the product is initially packaged aseptically) is to allow the entrance of sterile air only to replace dispensed product. In practice, ensuring that only sterile air is allowed to enter containers in a food service setting is extremely impractical.

An alternate means of ensuring that products are dispensed hygienically and in a shelf life promoting manner is to prevent any additional air from entering the container during dispensing. This can only be done with flexible packaging or a semi-rigid container that is able to fold partially into itself as product is dispensed, thereby reducing the volume of the container and mooting the need for replacement air.

Accordingly, there exists a need for a semi-rigid container that is collapsible into itself. Such a container combines the strength of a rigid plastic container with the flexibility required to dispense products hygienically and in a shelf life promoting manner. Desirably, the container appears to be a normal, rigid container, and may be handled as such. Most desirably, empty collapsed containers may be stacked into each other, reducing wasted space. In addition, containers may begin the filling process in the collapsed state, expanding as the process continues and allowing very little air to enter the product. Theoretically, this would allow for an increase in filling process speed.

BRIEF SUMMARY OF THE INVENTION

A collapsible, semi-rigid container includes a neck portion with an opening, a bottom wall portion, and a peripheral side wall extending between the neck and bottom wall. The side wall has an upper portion formed of a rigid material, and a lower portion formed of a soft material.

In a preferred embodiment, the lower portion of the container's side wall collapses up and into the upper portion of the side wall, thereby reducing the container's internal volume. Preferably, no air is allowed to enter the container as its lower side wall collapses into its upper side wall.

In a preferred embodiment, the neck portion, like the side wall upper portion, is formed of a rigid material. Most preferably, the neck and upper side wall portions are formed of a high density polyethylene (HDPE).

In a preferred embodiment, the bottom wall portion, like the side wall lower portion, is formed of a soft material. Most preferably, the bottom wall and lower side wall portions are formed of a low density polyethylene (LDPE).

In the preferred embodiment, the peripheral side wall is substantially circular in shape. Preferably, the cross-sectional area of the upper side wall increases in area from the neck to the lower side wall.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
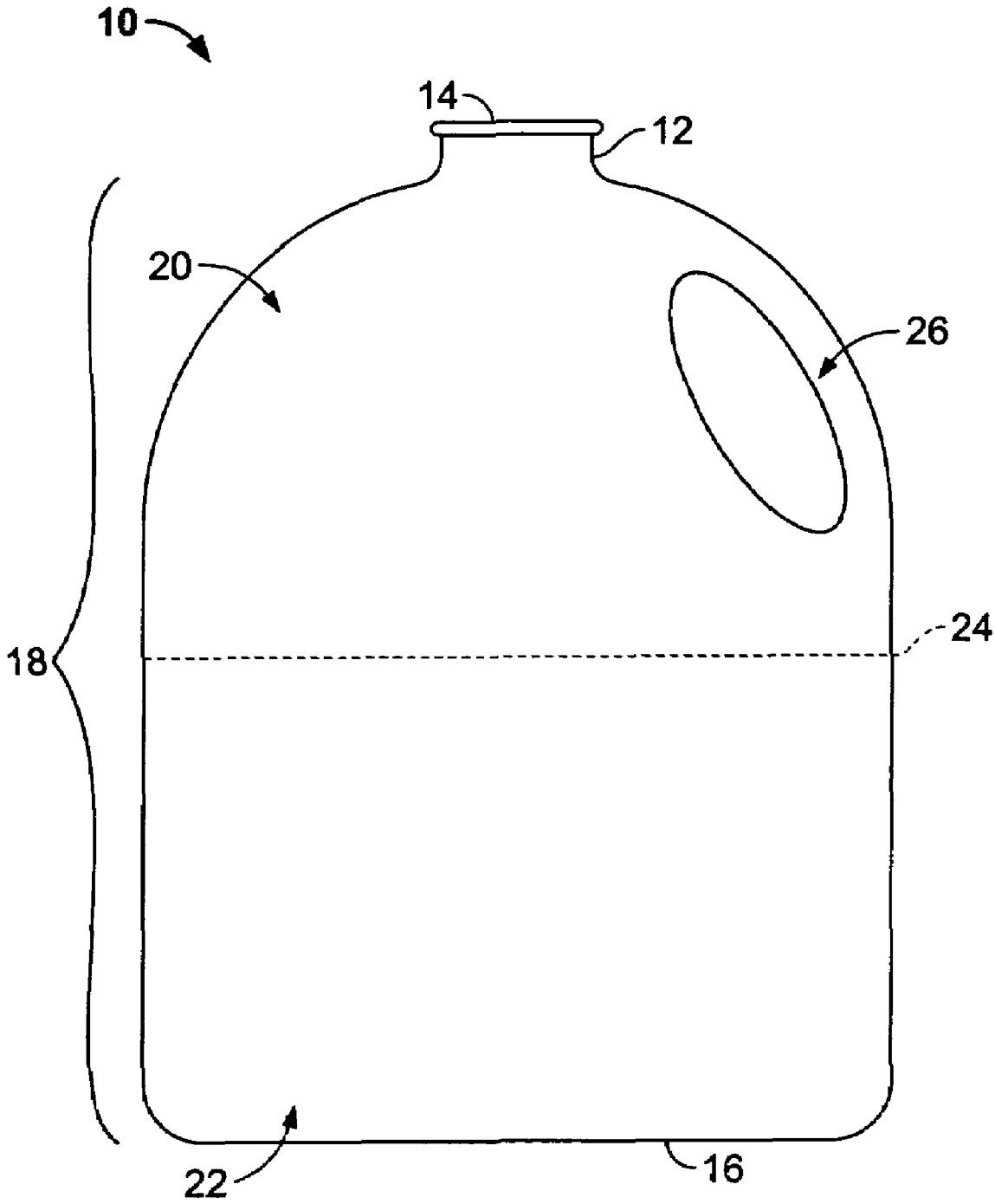
FIG. 1 illustrates a semi-rigid collapsible container embodying the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring to the figures and in particular FIG. 1 there is shown a semi-rigid collapsible container 10 in accordance with the principles of the present invention. The container includes a neck portion 12 having an opening 14, a bottom wall portion 16, and a peripheral side wall 18. The side wall 18 includes an upper portion 20 and a lower portion 22. The upper portion 20 is formed of a rigid material. The lower portion 22 is formed of a soft or flexible material. A dotted line 24 indicates a transition between the upper portion 20 and lower portion 22 of the side wall 18. The neck portion 12, opening 14, bottom wall portion 16, and side wall 18 are all formed using standard extrusion blow molding techniques.

In a present embodiment, the neck portion 12 is formed of a rigid material. An exemplary rigid material for both the neck portion 12 and the upper portion 20 of the side wall 18 is high density polyethylene (HDPE). In a current embodiment, the bottom wall portion 16 is formed of a soft material. An exemplary material for both the bottom wall portion 16 and the lower portion 22 of the side wall 18 is low density polyethylene (LDPE).

In a current embodiment, the side wall 18 of the container 10 is substantially circular in shape. Preferably, the cross-sectional area of the upper portion 20 of the side wall 18 increases from the neck portion 12 to the lower portion 22 of the side wall 18. A gripping handle 26 may be molded in the upper portion 20 of the side wall 18.

Figure 2:
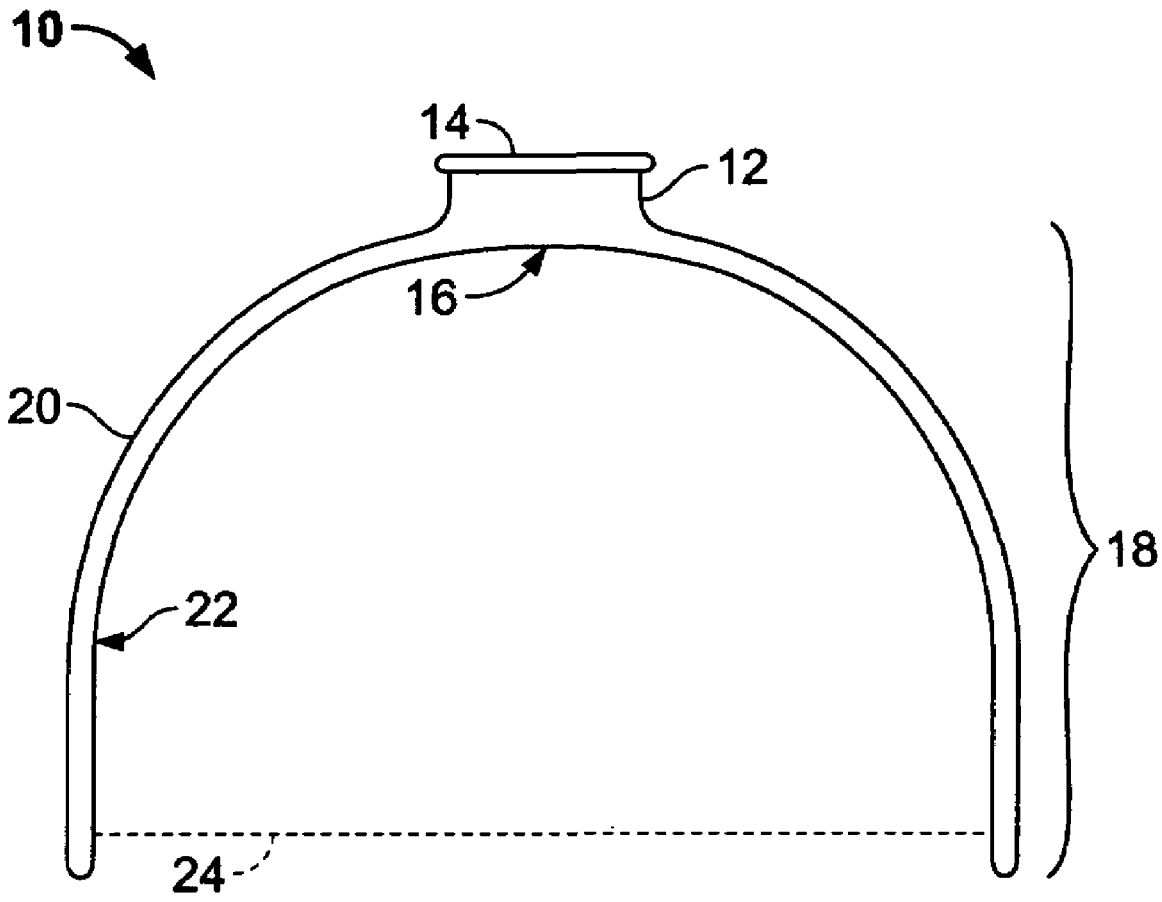
FIG. 2 shows the semi-rigid collapsible container of FIG. 1 in a collapsed state.

Referring now to FIG. 2, the container 10 of FIG. 1 is shown in a collapsed state (without its gripping handle 26). The rigidity of the upper portion 20 of the side wall 18 causes it to remain stable and unchanged. In contrast, the flexibility of the lower portion 22 of the side wall 18 and the bottom portion 16 allow them to collapse upwards into the upper portion 20 of the side wall 18 as product is removed, thereby greatly reducing the container's internal volume. A dotted fold line 24 indicates where the upper portion 20 and lower portion 22 of the side wall 18 join together. The shape of the collapsed container 10 allows empty, collapsed containers to be stacked into each other, allowing for a much more efficient use of space.

The present collapsible, semi-rigid container provides a number of advantages over known large, commercial or institutional packaging solutions. First, the present collapsible container, as discussed above, preclude the need for air ingress into the container to continue dispensing. This reduces the opportunity for oxygen contact with the food product (and likely degradation), and reduces the opportunity for bacterial contamination of the food product.

In addition, prior to "filling" the package, the flexible or collapsible lower portion can facilitate reduced storage requirements and consequently reduced shipping and handling costs. It is anticipated that the flexible lower portion can be collapsed into the upper portion to permit stacking or nesting of the containers to reduce the empty storage volume.

Forming the containers can be carried out using a number of known processes. A preferred process or method uses a co-extrusion system having separate screws to supply the HDPE and LDPE feed materials to a single mold. Those skilled in the art will recognize and appreciate the described co-extrusion process, as well as other process and methods for forming the container.

All patents referred to herein, are hereby incorporated herein by reference, whether or not specifically do so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A non-externally supported collapsible, semi-rigid container comprising:

a neck portion having an opening, a bottom wall portion, and a peripheral side wall extending between the neck and the bottom wall and having an upper portion and a lower portion, wherein the entirety of the upper portion is formed of a first, rigid material and the entirety of the lower portion is formed of a second, flexible material, the first and second materials being different from one another and formed in a molding process such that the upper portion and lower portion are formed as an integral unit, wherein the lower portion is collapsed into the rigid upper portion for storage and collapses into the rigid upper portion when dispensing a product from the container, and wherein when filled, the lower portion is of a shape and configuration to provide structural stability.

2. The container in accordance with claim 1 wherein the lower portion of the side wall collapses up and into the upper portion of the side wall, reducing an internal volume of the container.

3. The container in accordance wit claim 1 wherein the peripheral side wall is substantially circular in shape.

4. The container in accordance with claim 1 wherein the upper portion of the side wall has an increasing cross-sectional area from the neck portion to the lower portion of the side wall.

5. The container in accordance with claim 1 wherein the upper portion of the side wall includes a gripping handle.

6. The container in accordance with claim 1 wherein the neck portion is formed of a rigid material.

7. The container in accordance with claim 1 wherein the bottom wall portion is formed of a flexible material.

8. The container in accordance with claim 1 wherein the first material is high density polyethylene.

9. The container in accordance with claim 8 wherein the neck portion is formed from the first material.

10. The container in accordance with claim 1 wherein the second material is low density polyethylene.

11. The container in accordance with claim 10 wherein the bottom wall portion is formed from the second material.

* * * * *